US010094388B2

(12) United States Patent
Keller et al.

(10) Patent No.: US 10,094,388 B2
(45) Date of Patent: Oct. 9, 2018

(54) LOAD-RELIEVING DEVICE

(71) Applicant: KSB Aktiengesellschaft, Frankenthal (DE)

(72) Inventors: Thomas Keller, Frankenthal (DE); Gerhard Meyer, Frankenthal (DE)

(73) Assignee: KSB Aktiengesellschaft, Frankenthal (DE)

( * ) Notice: Subject to any disclaimer, the term of this patent is extended or adjusted under 35 U.S.C. 154(b) by 319 days.

(21) Appl. No.: 15/037,777

(22) PCT Filed: Nov. 10, 2014

(86) PCT No.: PCT/EP2014/074134

§ 371 (c)(1),
(2) Date: May 19, 2016

(87) PCT Pub. No.: WO2015/074903

PCT Pub. Date: May 28, 2015

(65) Prior Publication Data

US 2016/0298638 A1 Oct. 13, 2016

(30) Foreign Application Priority Data

Nov. 21, 2013 (DE) ..... 10 2013 223 806

(51) Int. Cl.
*F04D 29/041* (2006.01)
*F04D 1/00* (2006.01)
(Continued)

(52) U.S. Cl.
CPC ..... *F04D 29/041* (2013.01); *F04D 1/00* (2013.01); *F04D 17/08* (2013.01); *F04D 29/046* (2013.01);
(Continued)

(58) Field of Classification Search
CPC ..... F04D 1/00; F04D 17/08; F04D 29/041; F04D 29/0413; F04D 29/0416;
(Continued)

(56) References Cited

U.S. PATENT DOCUMENTS 3,393,947 A * 7/1968 Sandy, Jr. ..... F16C 17/04 384/303
3,468,259 A * 9/1969 Morzynski ..... F04D 29/0416 277/358
(Continued)

FOREIGN PATENT DOCUMENTS

CN 87100241 A 9/1988
DE 886 250 C 8/1953
(Continued)

OTHER PUBLICATIONS

English translation of Japanese Office Action issued in counterpart Japanese Application No. 2016-531991 dated Aug. 18, 2017 (Five (5) pages).
(Continued)

*Primary Examiner* — Igor Kershteyn
(74) *Attorney, Agent, or Firm* — Crowell & Moring LLP

(57) ABSTRACT

An arrangement for compensating the axial thrust of a fluid-flow machine is provided. A load-relieving element is non-rotatably connected to a shaft. A flow-restrict gap is formed by the load-relieving element and a counter-element secured to a housing of the fluid-flow machine. The counter-element is provided with a device for maintaining the distance between the load-relieving element and the counter-element. The device includes at least one force-generating element that generates a force that acts in opposition to the axial thrust in order to avoid component contact.

10 Claims, 2 Drawing Sheets

(51) Int. Cl.

| | |
|---|---|
| ***F04D 17/08*** | (2006.01) |
| ***F04D 29/046*** | (2006.01) |
| ***F04D 29/051*** | (2006.01) |
| ***F04D 29/056*** | (2006.01) |
| ***F04D 29/42*** | (2006.01) |

(52) U.S. Cl.
CPC ..... *F04D 29/0413* (2013.01); *F04D 29/0416* (2013.01); *F04D 29/051* (2013.01); *F04D 29/056* (2013.01); *F04D 29/0513* (2013.01); *F04D 29/0516* (2013.01); *F04D 29/4206* (2013.01); *F04D 29/426* (2013.01)

(58) Field of Classification Search
CPC .. F04D 29/426; F04D 29/4206; F04D 29/051; F04D 29/0516; F04D 29/0513; F04D 29/046; F04D 29/056
See application file for complete search history.

(56) References Cited

U.S. PATENT DOCUMENTS

| | | | | |
|---|---|---|---|---|
| 3,549,277 | A | 12/1970 | De Kiss et al. | |
| 4,157,834 | A * | 6/1979 | Burdette | F01D 11/003 277/306 |
| 5,531,458 | A * | 7/1996 | Sedy | F16J 15/3412 277/400 |
| 5,531,564 | A * | 7/1996 | Anttonen | F04D 1/06 415/104 |
| 5,713,720 | A | 2/1998 | Barhoum | |
| 6,367,241 | B1 | 4/2002 | Ress, Jr. et al. | |
| 7,001,159 | B2 * | 2/2006 | Peterson, Jr. | F04D 29/106 277/427 |
| 2002/0114713 | A1 | 8/2002 | Wang et al. | |
| 2004/0151581 | A1 | 8/2004 | Hellmann et al. | |
| 2008/0031736 | A1 | 2/2008 | Liao et al. | |
| 2008/0181546 | A1 | 7/2008 | Simon et al. | |
| 2009/0246048 | A1 * | 10/2009 | Kawasaki | F04D 17/168 417/423.4 |
| 2014/0041383 | A1 | 2/2014 | Hauck et al. | |

FOREIGN PATENT DOCUMENTS

| | | | |
|---|---|---|---|
| DE | 1 745 898 | U | 5/1957 |
| DE | 1 528 717 | A1 | 10/1969 |
| DE | 1 751 476 | A | 8/1970 |
| DE | 199 27 135 | A1 | 12/2000 |
| DE | 10 2011 004 975 | A1 | 9/2012 |
| EP | 2 060 804 | A1 | 5/2009 |
| JP | 44-16618 | A | 7/1969 |
| JP | 2002-227794 | A | 8/2002 |
| JP | 2004-169704 | A | 6/2004 |
| JP | 2006-77694 | A | 3/2006 |
| SU | 1 724 949 | A1 | 4/1992 |

OTHER PUBLICATIONS

English Translation of Korean Office Action issued in counterpart Korean Application No. 10-2016-7016409 dated Sep. 30, 2017 (Four (4) pages).

English translation of Chinese-language Office Action issued in counterpart Chinese Application No. 201480063672.5 dated Apr. 1, 2017 (Seven (7) pages).

International Search Report (PCT/ISA/210) issued in PCT Application No. PCT/EP2014/074134 dated Feb. 12, 2015 with English translation (five pages).

German-language Written Opinion (PCT/ISA/237) issued in PCT Application No. PCT/EP2014/074134 dated Feb. 12, 2015 (five pages).

German Office Action issued in German Patent Application No. 10 2013 223 806.1 dated Nov. 4, 2015 (four pages).

International Preliminary Report on Patentability (PCT/IB/338 & PCT/IB/373) issued in PCT Application No. PCT/EP2014/074134 dated May 24, 2016, including English translation of document C2 (German-language Written Opinion (PCT/ISA/237)) previously filed on May 19, 2016 (6 pages).

* cited by examiner

LOAD-RELIEVING DEVICE

CROSS REFERENCE TO RELATED APPLICATIONS

This application is a National Stage of PCT International Application No. PCT/EP2014/074134, filed Nov. 10, 2014, which claims priority under 35 U.S.C. § 119 from German Patent Application No. 10 2013 223 806.1, filed Nov. 21, 2013, the entire disclosures of which are herein expressly incorporated by reference.

BACKGROUND AND SUMMARY OF THE INVENTION

The invention relates to an arrangement for compensating the axial thrust of a fluid-flow machine, having a load-relieving element, which is connected for conjoint rotation to a shaft and, together with a counter-element fixed in relation to the casing, forms a radial flow-restrictor gap.

Axial thrust is the resultant of all the axial forces acting on the rotor of a fluid-flow machine. A distinction is drawn between different types of axial thrust compensation.

Essentially three types of load-relieving devices are known for absorbing the axial thrust: balancing disk, single-acting piston and double-acting piston. Common to all three embodiments is a relief flow guided through gaps. The relief flow, which is generally fed hack to the inlet of the centrifugal pump, represents a leakage loss, with gap widths that are as small as possible being used in an attempt to minimize this.

The aim is to achieve a controlled axial position of the rotor in all operating states of the fluid-flow machine in order to ensure trouble-free operation of the fluid-flow machine. During the operation of the centrifugal pump, rubbing of moving parts against fixed parts must be avoided.

During the operation of a fluid-flow machine with a balancing disk, the pressure difference acting between two sides of the load-relieving element leads to a load-relieving force which is opposed to the axial thrust. Here, the load-relieving force is precisely equal to the axial thrust. There is an equilibrium of forces on the rotor. Rubbing of the load-relieving element against the counter-element is prevented.

During startup and shutdown processes, this pressure difference has not yet been built up, with the result that contact occurs between the load-relieving element and the counter-element without appropriate countermeasures. Such cases of the radial gap surfaces running together is supposed to be prevented with the aid of spring assemblies in the "lift-off device".

German patent document no. DE 886 250 describes a lift-off device for centrifugal pumps. The lift-off device forms a separate component element, the rotating parts of which are secured on the shaft stub of the centrifugal machine, said stub facing away from the input side. The nonrotating parts are supported on the casing of the centrifugal machine. In these conventional devices for absorbing the axial forces during startup and shutdown, spring assemblies are arranged in a separate space outside the region through which fluid flows. This space is sealed off from the pumping medium. Such designs lead to an extended overall length. Moreover, a dedicated casing must be provided for the device.

Another possibility for taking up the axial forces during startup and shutdown processes of fluid-flow machines consists in the use of a Cardan ring.

German patent document no. DE 199 27 135 A1 describes a load-relieving device for multi-stage centrifugal pumps in which a Cardan ring is used. The Cardan ring is dimensioned in such a way that it is elastically deformed by the residual thrust. The Cardan ring is arranged in a separate sealed space. This design too leads to an additional overall length of the fluid-flow machine.

A device for limiting the axial thrust of the pump rotor of a centrifugal machine is described in German patent document no. DE 1 745 898 U. The load-relieving element is prevented from running up against the counter-element by the fact that a freely movable thrust bearing and an outer bearing ring rest against a support bearing flange owing to spring force, exercising a limiting effect. Oil lubrication is required for this design. With this design too, the overall length of the machine is increased by a corresponding shaft section where the corresponding casing is sealed off from the pumping medium.

It is the object of the invention to specify an arrangement for compensating the axial thrust of a fluid-flow machine, in which the load-relieving element is reliably prevented from rubbing against a counter-element, even during startup or shutdown. At the same time, prevention of running contact should not lead to an additional overall length of the fluid-flow machine. A dedicated casing and the use of an additional lubricant should also be avoided.

According to the invention, this object is achieved by virtue of the fact that a device for maintaining the distance between the load-relieving element and the counter-element is arranged on the counter-element, said device having at least one force-generating element, which generates a force opposed to the axial thrust.

According to the invention, the device is arranged on the counter-element itself. The device is situated in the region of the fluid-flow machine through which the medium flows. Thus, there is no need for any extension of the shaft or an additional casing. Moreover, a separate lubricant is eliminated with the device according to the invention.

The device has at least one force-generating element, which generates a force opposed to the axial thrust. The force-generating element can operate hydraulically or magnetically, for example. The use of piezoelectric elements for force generation is also possible.

In a particularly advantageous embodiment of the invention, a spring is used as the force-generating element. This is inexpensive to produce and proves to be extremely reliable in preventing the load-relieving element from rubbing against the counter-element. Moreover, no additional driving means are required.

The device preferably has an axially movable element in addition to the force-generating element. In an advantageous embodiment of the invention, the axially movable element has at least one region which engages at least partially in a guide formed by the counter-element. For this purpose, the axially movable element can have an annular projection which engages in an annular recess in the counter-element.

In a preferred embodiment of the invention, the force-generating element is arranged between the counter-element fixed in relation to the casing and the axially movable element. In this case, a space is formed in which the force-generating element is positioned. Here, the force-generating element can be supported on the counter-element and act on the axially movable element.

The load-relieving element has surfaces which face a high-pressure space and surfaces which face a low-pressure space. During the operation of the fluid-flow machine, the pressure difference between the high-pressure space and the low-pressure space leads to a load-relieving force which is opposed to the axial thrust. Here, the load-relieving force is precisely equal to the axial thrust. There is an equilibrium of forces on the rotor. Rubbing of the load-relieving element against the counter-element is prevented.

Since this pressure difference has not yet been built up during startup or shutdown processes, provision is made, according to the invention, for a force to be built up by the force-generating element during startup and/or shutdown, said element being arranged on the counter-element. This force acts on an axially movable element. As a result, the axially movable element is moved in the direction of the load-relieving element.

A sliding bearing element is preferably arranged on the axially movable element. In a particularly advantageous embodiment of the invention, the sliding bearing element is composed of a high-strength thermoplastic. A plastic based on polyaryletherketones has proven particularly advantageous here. Polyetheretherketone (PEEK) is preferably used. This sliding element allows sliding lubricated by the medium.

During startup or shutdown processes, the axially movable element is moved to such an extent by the force-generating element that the sliding bearing element rests on the load-relieving element. The sliding bearing element thus serves as a stop for the load-relieving element, thus preventing the load-relieving element from rubbing against the counter-element.

By virtue of the choice of material according to the invention, sliding of the load-relieving element on the sliding bearing element is lubricated by the medium, preventing the load-relieving element from rubbing against the counter-element. Damage to the counter-element and/or the load-relieving element is thereby prevented. No abrasion occurs, and therefore the desired geometry of the radial flow-restrictor gap is maintained.

The sliding bearing element is preferably a ring. In a particularly advantageous embodiment of the invention, the ring is arranged in a receptacle formed by the axially movable element. For this purpose, the axially movable element can have a groove, in which the sliding element rests. The sliding element is preferably fixed on the axially movable element by means of an adhesive and/or of some other fixing means.

During the startup phase, the axially movable element is moved toward the load-relieving element. If a pressure difference then builds up between the high-pressure space and the low-pressure space, a pressure difference acts on the load-relieving element, leading to a load-relieving force and moving the rotor counter to the axial thrust.

When the fluid-flow machine is running at the desired speed, a pressure acts on the axially movable element and the sliding bearing element. As a result, the axially movable element moves away from the load-relieving element toward the counter-element. The axially movable element, together with the sliding bearing element, is thus moved into a retracted position.

A sealing element is preferably arranged between the axially movable element and the counter-element. Using this sealing element, a high-pressure space is separated from a low-pressure space. The force-generating element is arranged in a space in which lower pressure prevails.

The counter-element preferably has an opening, which connects the space in which the force-generating element is arranged to the load-relieving space. With this connection, medium can escape from or flow into the space when the axially movable element is moved.

As the machine is shut down, e pressure difference between the high-pressure and the low-pressure space decreases, with the result that the load-relieving force declines and the flow-restrictor gap becomes smaller. As a result, the pressure acting in the high-pressure space on the axially movable element and the sliding bearing element also decreases. Thus, a new equilibrium is established, at which the force-generating element moves the axially movable element toward the load-relieving element. As a result, the axially movable element moves forward. In this position, the balancing disk rests against the sliding bearing element and prevents the load-relieving element from rubbing against the counter-element.

Other objects, advantages and novel features of the present invention will become apparent from the following detailed description of one or more preferred embodiments when considered in conjunction with the accompanying drawings.

DETAILED DESCRIPTION OF THE DRAWINGS

Figure 1:
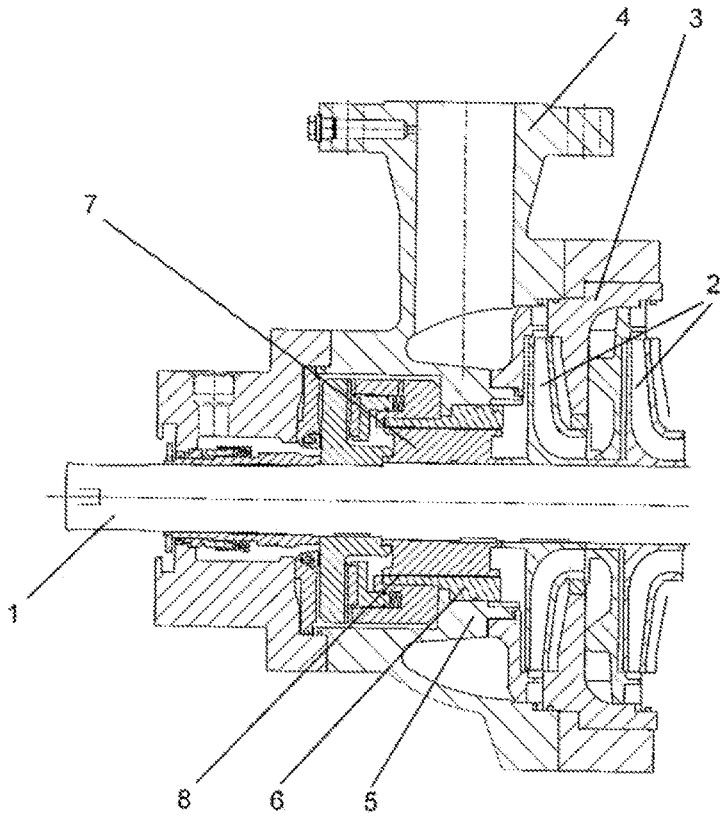
FIG. 1 shows an arrangement for compensating the axial thrust installed in a centrifugal pump in accordance with embodiments of the present invention.

FIG. 1 shows a centrifugal pump having a shaft 1, which carries a plurality of rotors 2. The rotors are surrounded by a stepped casing 3. The pumping medium flows through a discharge casing 4.

An axial flow-restrictor gap 8 is formed between a restrictor sleeve 6, which is connected to the discharge casing 4, and a component 7, also referred to as a piston, which is connected for conjoint rotation to the shaft 1 and on the outer circumference of which a polyetheretherketone layer is preferably provided.

Pumping fluid is diverted from the high-pressure region of the centrifugal pump through the axial flow-restrictor gap 8 and routed as a load-relieving flow.

Figure 2:
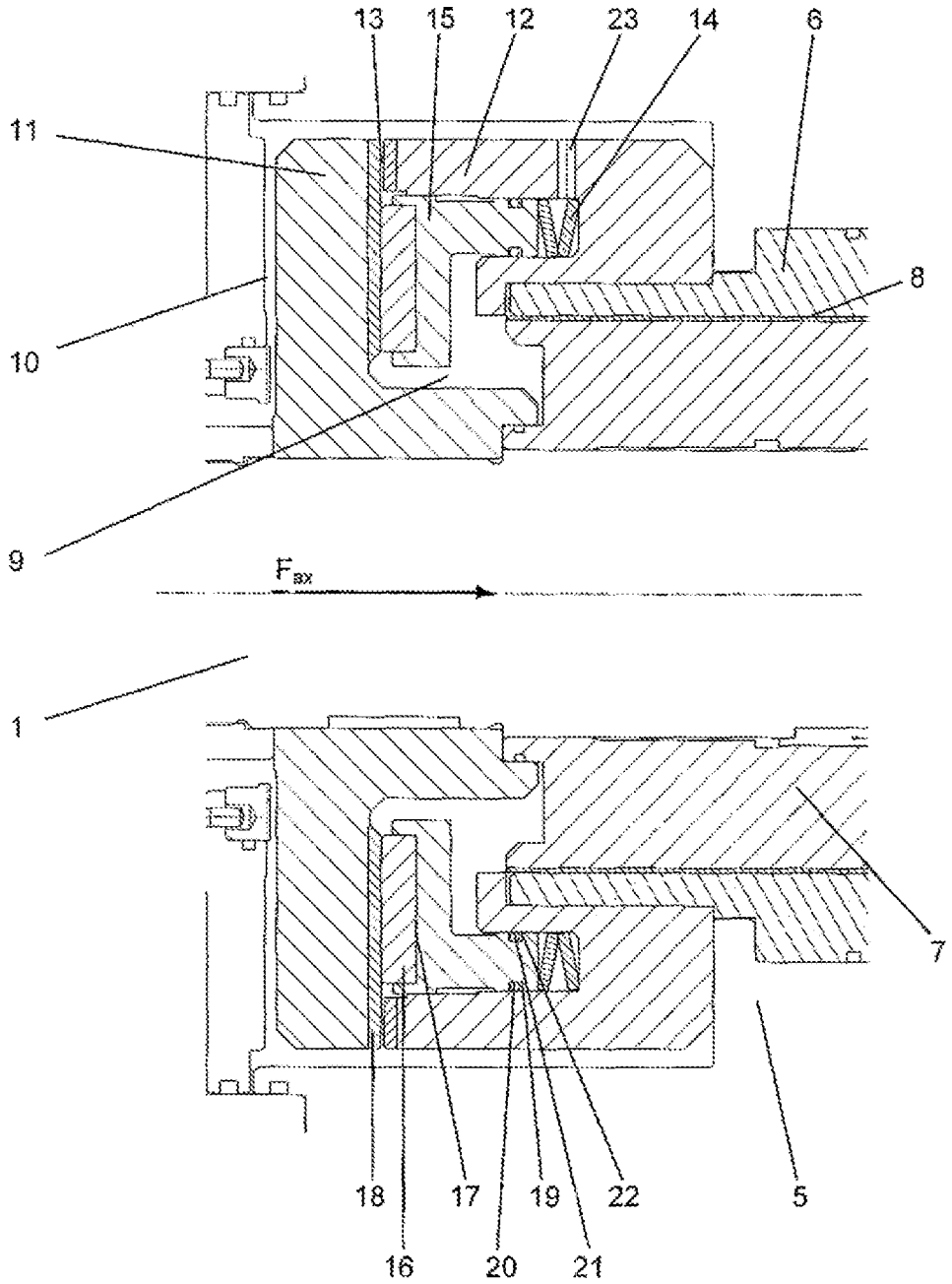
FIG. 2 shows a detail of an axial section through a multi-stage centrifugal pump in accordance with embodiments of the present invention.

The spaces 9 and 10 shown in FIG. 2 are filled with fluid. This is preferably the pumping medium of the centrifugal pump. During the operation of the centrifugal pump, the pressure in space 9 is significantly higher than in space 10. A load-relieving element 11 is arranged between the "high-pressure" space 9 and the "low-pressure" space 10. In the illustrative embodiment, the load-relieving element 11 is a balancing disk. The load-relieving element 11 is connected for conjoint rotation to the shaft 1.

The pressure difference $\Delta p = p9 - p10$ acting on the surfaces of the load-relieving element 11 results in a load-relieving force opposing the axial thrust Fax. In the illustrative embodiment, the axial thrust acts from left to right when looking at the drawing. The load-relieving force generated by virtue of the pressure difference $\Delta p = p9 - p10$ acts from right to left when looking at the drawing.

A radial flow-restrictor gap 13 is formed between the load-relieving element 11 and a counter-element 12. The counter-element 12 is firmly connected to the casing.

If the axial thrust changes during operation and the load-relieving force falls, the rotor moves in the direction of the intake side of the pump and the radial flow-restrictor gap 13 becomes narrower. Owing to the greater restriction across the flow-restrictor gap 13, the pressure p9 increases, as does therefore the load-relieving force. If the load-relieving force is greater than the axial thrust, the excess force moves the rotor toward the rear side of the pump, and the flow-restrictor gap 13 becomes larger. This has the effect that the pressure p9 acting on the load-relieving element and also the load-relieving force fall again. Force equilibria, at which a flow-restrictor gap of about 0.05 to 0.1 mm is formed, are established at the rotor. The load-relieving element 11 acts as a self-regulating hydrodynamic thrust be in the arrangement according to the invention.

To ensure that the system remains stable and the control movements do not take place too quickly, the axial flow-restrictor gap 8 must be designed in such a way that a radial flow-restrictor gap 13 of more than 0.01 mm and less than 0.12 min is established.

The relatively small load-relieving flow is advantageous when using a balancing disk as a load-relieving element 11 ensuring that high volumetric efficiencies are achieved. In the case of conventional balancing disks, the increased susceptibility to gear was previously a disadvantage.

In the device according to the invention, wear is prevented by a device for maintaining the distance between the load-relieving element 11 and the counter-element 12 when starting up and/or shutting down. According to the invention, the device is arranged on the counter-element 12. The device comprises a force-generating element 14. The force-generating element 14 generates a force opposed to the axial thrust when starting up and/or shutting down, said force ensuring that a distance is maintained between the load-relieving element 11 and the counter-element 12.

The device for maintaining the distance has an axially movable element 15. The force-generating element 14 is arranged between the axially movable element 15 and the counter-element 12 fixed in relation to the casing.

The device furthermore comprises a sliding bearing element 16, which is supported by the axially movable element 15. For this purpose, the axially movable element 15 has a recess 17, in which the sliding bearing element 16, which is designed as a ring, is arranged. The recess 17 is designed as a circular groove.

The end of the sliding bearing element 16 faces the load-relieving element 11. The sliding bearing element 16 is composed of polyetheretherketone (PEEK).

The sliding bearing element 16 preferably has a structured end facing the load-relieving element 11 and having channels (not shown). A sliding bearing lubricated by the medium is thereby made possible.

During startup and shutdown, the pressure difference $\Delta p = p9 - p10$ is so small that the load-relieving element 11 would rest against the counter-element 12 if an axial thrust were to occur. This rubbing of the load-relieving element 11 against the counter-element 12 would lead to considerable wear phenomena.

In the arrangement according to the invention, the force-generating element 14 moves the axially movable element 15 from right to left when looking at the drawing. During this process, the sliding bearing element 16 rests on the load-relieving element 11, which has an armored region 18 on the side facing the sliding be g element 16. During startup or shutdown, a sliding bearing lubricated by the medium is thus created between the load-relieving element 11 and the sliding bearing element 16. Rubbing of the load-relieving element 11 against the counter-element 12 is prevented in this case.

As soon as a sufficient pressure difference $\Delta p = p9 - p10$ has built up between the two spaces 9 and 10, a flow-restrictor gap is established between the load-relieving element 11 and the counter-element 12. An increased pressure p9 also acts on the end of the sliding bearing element 16. Owing to this pressure p9, the axially movable element 15 is moved from left to right when looking at the drawing. The device is now in its retracted operating position.

The arrangement according to the invention thus provides a device which disengages during startup or shutdown and thus moves from right to left, and moves back into its operating position during the operating state and is thus moved from left to right when looking at the drawing.

The axially movable element 15 has a first groove 19, in which a sealing element 20 designed as an O-ring is arranged. Moreover, the axially movable element 15 has a second groove 21, in which a sealing element 22 designed as an O-ring is arranged. Sealing elements 20 and 72 separate the "high-pressure" space 9 from the "low-pressure" space 10.

The counter-element 12 has an opening 23, which connects a space in which the force-generating element 14 is arranged to the load-relieving space 10. The opening 23 is embodied as a pressure equalizing bore.

When the delivery pressure falls during shutdown, the axially movable element 15 moves back into its advance position and prevents the e restrictor surfaces from running up against one another.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

The invention claimed is:

1. An arrangement for compensating the axial thrust of a fluid-flow machine, comprising:

a rotatable shaft;

a casing configured to receive the shaft;

a load-relieving element configured for conjoint rotation with the shaft within the casing;

a counter-element configured to be non-rotatably fixed to the casing, the counter element and the load-relieving element being arranged to cooperate to form a radial flow-restrictor gap therebetween; and a distance-maintaining element configured to prevent the radial flow restrictor gap between the counter element and the load-relieving element being closed, the distance-maintaining element including at least one force-generating element configured to generate a force opposed to an axial thrust created during rotation of the shaft within the casing.

2. The arrangement as claimed in claim 1, wherein the distance-maintaining element includes an axially movable element movable along a longitudinal axis of the shaft.

3. The arrangement as claimed in claim 2, wherein the at least one force-generating element is arranged between the counter-element and the axially movable element.

4. The arrangement as claimed in claim 3, wherein a sliding bearing element is arranged on the axially movable element.

5. The arrangement as claimed in claim 4, wherein the counter-element includes a guide for the axially movable element.

6. The arrangement as claimed in claim 5, wherein at least one sealing element is arranged between the axially movable element and the counter-element.

7. The arrangement as claimed in claim 6, wherein the counter-element includes an opening between a first space in which the force-generating element is located and to a second space.

8. A method for compensating the axial thrust of a fluid-flow machine having a rotatable shaft, a casing configured to receive the shaft a load-relieving element configured for conjoint rotation with the shaft within the casing, a counter-element configured to be non-rotatably fixed to the casing, the counter element and the load-relieving element being arranged to cooperate to form a radial flow-restrictor gap therebetween, and a distance-maintaining element configured to prevent the radial flow restrictor gap between the counter element and the load-relieving element being closed, the distance-maintaining element including at least one force-generating element configured to generate a force opposed to an axial thrust created during rotation of the shaft within the casing, comprising the acts of:

generating a force opposing the axial thrust with the at least one force-generating element.

9. The method as claimed in claim 8, wherein during the act of generating the opposing force, the opposing force moves an axially movable element of the distance-maintaining element along a longitudinal axis of the shaft.

10. The method as claimed in claim 9, wherein the at least one force-generating element is arranged between the counter-element and the axially movable element, a sliding bearing element is arranged on the axially movable element, and the axial movement of the axially movable element causes the sliding bearing element to contact the load-relieving element in a manner that prevents contact between the load-relieving element and the counter-element.

* * * * *